US006773668B1

(12) United States Patent
Everson et al.

(10) Patent No.: US 6,773,668 B1
(45) Date of Patent: Aug. 10, 2004

(54) DETERGENT DISPENSER

(75) Inventors: Terrence P. Everson, Eagan, MN (US); Lee M. Monsrud, Inver Grove, MN (US); Michael P. Kremer, Rosemount, MN (US); Edward D. Sowle, Woodbury, MN (US)

(73) Assignee: Ecolab, Inc., St. Paul, MN (US)

( * ) Notice: Subject to any disclaimer, the term of this patent is extended or adjusted under 35 U.S.C. 154(b) by 0 days.

(21) Appl. No.: 09/550,428

(22) Filed: Apr. 17, 2000

(51) Int. Cl.[7] ..... A61L 2/00; B08B 7/00; D06F 29/00; E03B 11/00; B01D 15/00

(52) U.S. Cl. ..... 422/28; 422/106; 422/119; 422/232; 422/255; 422/264; 422/279; 422/292; 134/6; 134/26; 134/34; 134/36; 134/42; 134/93; 68/17 R; 137/268; 423/658.5; 210/198.1; 210/199; 210/752; 222/130; 222/145.5; 222/145.6; 222/181.1; 222/185.1; 222/477; 222/318

(58) Field of Search ..... 422/1, 28, 105–106, 422/119, 232, 255, 261, 265, 283, 292, 300, 307, 311, 901–902, 264, 279; 134/6–7, 26, 34, 36, 42, 93; 68/17 R; 137/268; 423/658.5; 210/198.1, 199, 752; 222/130, 145.5, 145.6, 181.1, 185.1, 477, 476, 318, 564

(56) References Cited

U.S. PATENT DOCUMENTS

| | | | | |
|---|---|---|---|---|
| 2,477,998 A | | 8/1949 | McCowan | 299/83 |
| 3,604,225 A | * | 9/1971 | Douglas | |
| 3,975,931 A | * | 8/1976 | Bischkopf | |
| 4,181,702 A | | 1/1980 | Watson | 422/265 |
| 4,418,712 A | * | 12/1983 | Braley | |
| 4,426,362 A | | 1/1984 | Copeland et al. | 422/263 |
| 4,438,534 A | | 3/1984 | Keyes et al. | 4/227 |
| 4,555,347 A | * | 11/1985 | O'Dowd et al. | |
| 4,687,121 A | | 8/1987 | Copeland | 222/64 |
| 4,690,305 A | | 9/1987 | Copeland | 222/52 |
| RE32,818 E | | 1/1989 | Fernholz et al. | 510/225 |
| 4,826,661 A | | 5/1989 | Copeland et al. | 422/106 |
| 5,262,132 A | | 11/1993 | Bricker et al. | |
| 5,268,153 A | | 12/1993 | Muller | 422/263 |
| 5,310,430 A | | 5/1994 | McCall, Jr. | 134/33 |
| 5,441,711 A | * | 8/1995 | Drewery | |
| 5,759,501 A | | 6/1998 | Livingston et al. | |
| 5,782,109 A | * | 7/1998 | Spriggs et al. | |
| 5,827,486 A | | 10/1998 | Crossdale | |

* cited by examiner

*Primary Examiner*—Terrence R. Till
*Assistant Examiner*—Monzer R. Chorbaji
(74) *Attorney, Agent, or Firm*—IPLM Group, P.A.

(57) ABSTRACT

A solid detergent dispenser for use with a dishwashing machine includes a chamber and a lid. The chamber is configured and arranged to receive a solid detergent having a particular composition. A water inlet receives water from a water source, and the water flows through a tunnel into the bottom of the chamber. The chamber is flooded with water from the bottom to ensure relatively constant erosion of the solid detergent, which ensures that a relatively constant concentration of the solid detergent is used in the dishwashing machine. A water outlet allows water to flow out of the chamber into the dishwashing machine. The water must flow into the chamber faster than it flows out of the chamber to ensure that the appropriate amount of dissolution of the solid detergent occurs. The only valve used in the preferred embodiment is a valve to control the amount of water flowing into the water inlet.

27 Claims, 7 Drawing Sheets

FIG. 7
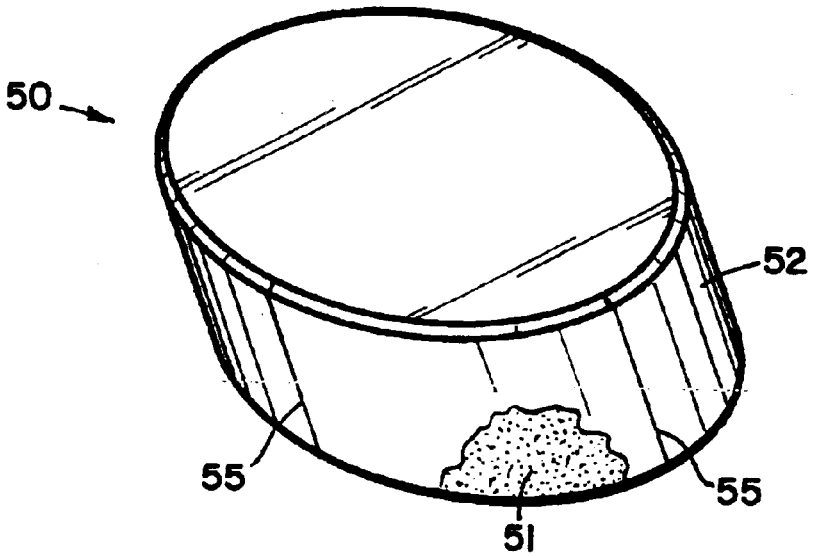
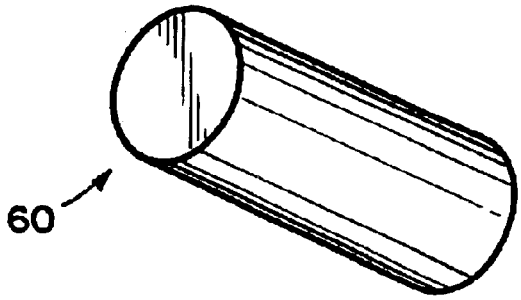
FIG. 8

DETERGENT DISPENSER

BACKGROUND OF THE INVENTION

1. Field of the Invention

The present invention relates to a detergent dispenser, and more specifically, the present invention relates to a solid detergent dispenser for use with a dishwashing machine.

2. Description of the Prior Art

A variety of spray-type dispensers for dispensing various cleaning compositions have been disclosed in U.S. Pat. Nos. 4,826,661; 4,690,305; 4,687,121; 4,426,362; and Re 32,818. Generally, a spray-type dispenser functions by impinging a liquid spray upon an exposed surface of a solid cleaning composition to dissolve a portion of the composition. Then, the concentrate solution comprising the dissolved composition is immediately directed out of the dispenser to a storage reservoir or directly to a point of use.

U.S. Pat. No. 4,826,661 by Copeland et al. discloses a solid block chemical dispenser for cleaning systems. The dispenser comprises a spray nozzle for directing a uniform dissolving spray onto an exposed surface of the solid block of cleaning composition and a spring or hydraulic piston coupled to the nozzle for biasing the nozzle towards the solid block and thereby maintaining a substantially constant distance between the nozzle and the exposed surface of the solid block of cleaning composition even though the exposed surface recedes due to dissolution by the dissolving spray.

U.S. Pat. No. 4,690,305 to Copeland discloses another solid block chemical dispenser for cleaning systems. The dispenser comprises a substantially horizontal support screen within a housing which retainably supports a solid block of wash chemical thereabove. The support screen divides the housing into an upper cylindrical storage portion and a lower funnel shaped collector portion. A spray forming nozzle is mounted within the collector portion below the generally horizontal screen for directing a spray of water at substantially the entire downwardly facing surface of the wash chemical block supportably retained above the support screen. The dissolved wash chemical passes through the support screen, is collected by the collector portion of the housing, and directed to its utilization point. Spray controls, either manual or electronic, control the spray of water through the nozzle in response to a control signal. The dispenser is configured for mounting to a vertical surface and is loaded through an upper access port normally closed by a door. A safety switch prevents the spray of water from the nozzle whenever the door is open.

Another solid block chemical dispenser for cleaning systems is disclosed in U.S. Pat. No. 4,687,121 by Copeland. A spray-type dispenser for on-demand dispensing of a solid block of chemical retained within a container in the form of an aqueous chemical solution of substantially constant concentration comprises an upwardly disposed spray nozzle, a three-dimensional support screen for supporting the solid block of chemical above the spray nozzle, and a housing enclosing the spray nozzle and support screen. The housing and support screen define an annular cavity. In operation, a container retaining a solid block of a water-soluble chemical is placed within the dispenser such that the support screen contacts the chemical but not the container, thereby allowing the container to descend, by force of gravity, into the annular cavity as the chemical retained therein is dissolved. The ability of the container to move in relation to dissolution of the chemical retained therein allows the dispenser to maintain a substantially constant distance between the spray nozzle and the exposed dissolving surface of the chemical and thereby maintains a substantially constant concentration of the aqueous chemical solution dispensed.

A detergent dispenser for efficiently converting one or more solid block detergent compositions into concentrated detergent solutions is disclosed in U.S. Pat. No. 4,426,362 by Copeland et al. A housing configured for mounting to a solid surface defines a substantially enclosed inner cavity, access and discharge ports, and an opening into the inner cavity. Retaining means holds a charge of solid block detergent composition, which may include a plurality of different and even chemically incompatible detergent composition components, in fixed predetermined position within the inner cavity, exposing at least one broad surface of the detergent block. Nozzle means projects into the cavity and directs a pressurized liquid spray against substantially the entire exposed detergent surface(s), dissolving a portion thereof, which is collected by the housing and passes through the discharge port. The nozzle means may be disposed above or below the exposed detergent surface. One embodiment of the retaining means comprises a disposable or rechargeable cartridge receptacle member, which is capable of being removably inserted into the inner cavity through the access port. The cartridge receptacle may include an overlying screen member and may be configured to define a plurality of different receptacles. Closure means and safety switching means cooperatively prevent hazardous spray from leaving the inner cavity.

Finally, U.S. Pat. No. Re 32,818 discloses a cast detergent-containing article and method of using the same. Solid cast detergent-containing articles are produced for use in automatic dishwashing machines. A liquid detergent composition is cast into a mold where it is allowed to solidify. The solid cast detergent, surrounded on all but its upper surface by the mold, is used in automatic dishwashing machines having a dispensing device designed to dispense a liquid aqueous detergent formed from the solid cast detergent using an impinging liquid spray. The liquid aqueous detergent flows out of the dispensing device generally simultaneously with its formation in the dispenser. The cast detergent composition includes an alkaline hydratable chemical and optionally further includes one or more preformed cores or plugs comprising an available chlorine source, a defoamer, or the like.

Therefore, in sum, prior art utilizes a solid detergent block and relies on an impinging liquid spray to form a liquid detergent. The impinging liquid spray usually results in strange erosion of the detergent block, which negatively affects the rate of dissolution as the block is dissolved unevenly over time. Furthermore, prior art requires the use of additional valves and electronics to control the amount of water used in the dispenser. The present invention prevents the uneven erosion of the solid detergent block without the use of additional valves and/or electronics.

SUMMARY OF THE INVENTION

The present invention relates to a detergent dispenser, and more specifically, the present invention relates to a solid detergent dispenser for use with a washing machine. In a preferred embodiment method for dispensing a use solution from a solid detergent into a washing machine, a solid detergent having a bottom is placed in a dispenser having a chamber. The chamber defines a cavity and includes a water inlet and a water outlet, and the cavity is configured and arranged to receive the solid detergent. Water is supplied to a level within the cavity of the chamber so the solid detergent is in contact with the water. The solid detergent is flooded with water from the bottom of the solid detergent, and an amount of the solid detergent is dissolved in the water to form a use solution. Then, the use solution is dispensed from the water outlet into the washing machine.

In a preferred embodiment detergent dispenser, a chamber defines a cavity configured and arranged to receive a solid detergent and water. The chamber includes a bottom, a water inlet, and a water outlet. The water inlet is configured and arranged to receive water from a water source, and the water flows from the water inlet into the cavity where it floods the solid detergent from the bottom of the solid detergent and dissolves a portion of the solid detergent to form a use solution. The water outlet is configured and arranged to dispense substantially all of the use solution out of the chamber, and substantially all of the use solution is dispensed out of the chamber when the detergent dispenser is not in use.

In a preferred embodiment dispenser for dispensing a use solution from a solid detergent into a washing machine, a chamber includes a front portion, a first side portion, a second side portion, a back portion, a bottom portion, a top portion, and an opening. The chamber defines a cavity configured and arranged to receive the solid detergent and the water. The back portion of the chamber further comprises a water inlet proximate the top portion and a water outlet proximate the bottom portion. The water inlet is configured and arranged to receive the water from the water source. The water flows from the water inlet into the cavity from the bottom of the chamber where it contacts the solid detergent and dissolves a portion of the solid detergent to form a use solution. An air gap is proximate the water inlet to prevent the water from returning to the water source. A tunnel is proximate the back portion and the second side portion, wherein water travels from the water inlet, through the tunnel, and into the bottom portion of the chamber. The water fills the chamber to a level within the cavity to contact the solid detergent, wherein uniform dissolution of the solid detergent occurs thereby maintaining a relatively constant concentration and a relatively constant shape of the solid detergent. The water outlet is configured and arranged to dispense substantially all of the use solution out of the chamber and into the washing machine so that substantially all of the water is dispensed out of the chamber when the dispenser is not in use. A lid is connected to the top portion of the chamber to cover the opening of the chamber into the cavity.

In a preferred embodiment method for dispensing detergent, a detergent with a particular composition is placed into a dispenser having a cavity, a water inlet, and a water outlet. The cavity is configured and arranged to receive and support the detergent. Water is supplied to the water inlet and a valve is used to control the amount of water flowing into the water inlet. The dispenser is flooded with water to a level within the cavity wherein water contacts the detergent and dissolves a portion of the detergent to form a use solution. The use solution is then released through the water outlet, whereby a particular concentration of the use solution is dispensed. Water outlet is always open, and water is supplied to the water inlet at a rate faster than water is released through the water outlet, thus allowing water to contact the detergent and dissolve a portion of the detergent to form the use solution.

In a preferred embodiment dispenser for dispensing a use solution from a solid detergent into a washing machine, a dispenser includes a cavity, a water inlet, and a water outlet. The cavity is configured and arranged to receive and support a solid detergent. A conduit connects the water inlet to a water source, and a valve connected to the conduit controls the flow of water from the water source into the water inlet. The cavity is flooded with water to a level within the cavity, water contacts the solid detergent from the bottom of the solid detergent to form a use solution, and uniform dissolution of the solid detergent occurs, thus maintaining a relatively constant concentration and shape of the solid detergent. A hose member connects the water outlet to a washing machine, and substantially all of the use solution is dispensed out of the cavity through the water outlet and into the washing machine via the hose member.

In a preferred embodiment detergent dispenser for use with a washing machine, a dispenser has a chamber including a cavity, a water inlet, and a water outlet. A conduit connects the water inlet to a water source, and a valve is operatively connected to the conduit to control the amount of water flowing from the water source into the water inlet. A hose member is operatively connected to the water outlet and has a curvature. The curvature extends in an upward direction at a height greater than the water outlet and then extends downward below the water outlet. A first level of water within the cavity is controlled by the valve to reach a height below the curvature and does not flow out of the cavity. A second level of water within the cavity is controlled by the valve to reach a height greater than the curvature, and a siphoning effect occurs so all the water flows out of the dispenser via the water outlet.

In another preferred embodiment method of dispensing a use solution from a solid detergent into a washing machine, a solid detergent is placed inside a dispenser having a cavity, a water inlet, a water outlet, and a hose member operatively connected to the water outlet. The hose member has a curvature, wherein the curvature extends in an upward direction at a height greater than the water outlet and then extends downward below the water outlet. Water is supplied to the water inlet, and water flows from the water inlet to the cavity. The amount of water flowing into the water inlet is controlled by a valve. Water is flooded into the cavity to a first level, and the first level of water contacts the solid detergent contained within the dispenser to form a use solution. Water is then flooded into the cavity to a second level, and the second level of water initiates the flow of substantially all of the use solution out of the water outlet into a washing machine

BRIEF DESCRIPTION OF THE DRAWINGS

FIG. 7 is a front view of a solid block detergent for use with the dispenser shown in FIG. 1.

FIG. 8 is a perspective view of a solid pellet detergent for use with the dispenser shown in FIG. 1.

DETAILED DESCRIPTION OF THE PREFERRED EMBODIMENT

A preferred embodiment dispenser constructed according to the principles of the present invention is designated by the numeral 10 in FIGS. 1–6.

Figure 1:
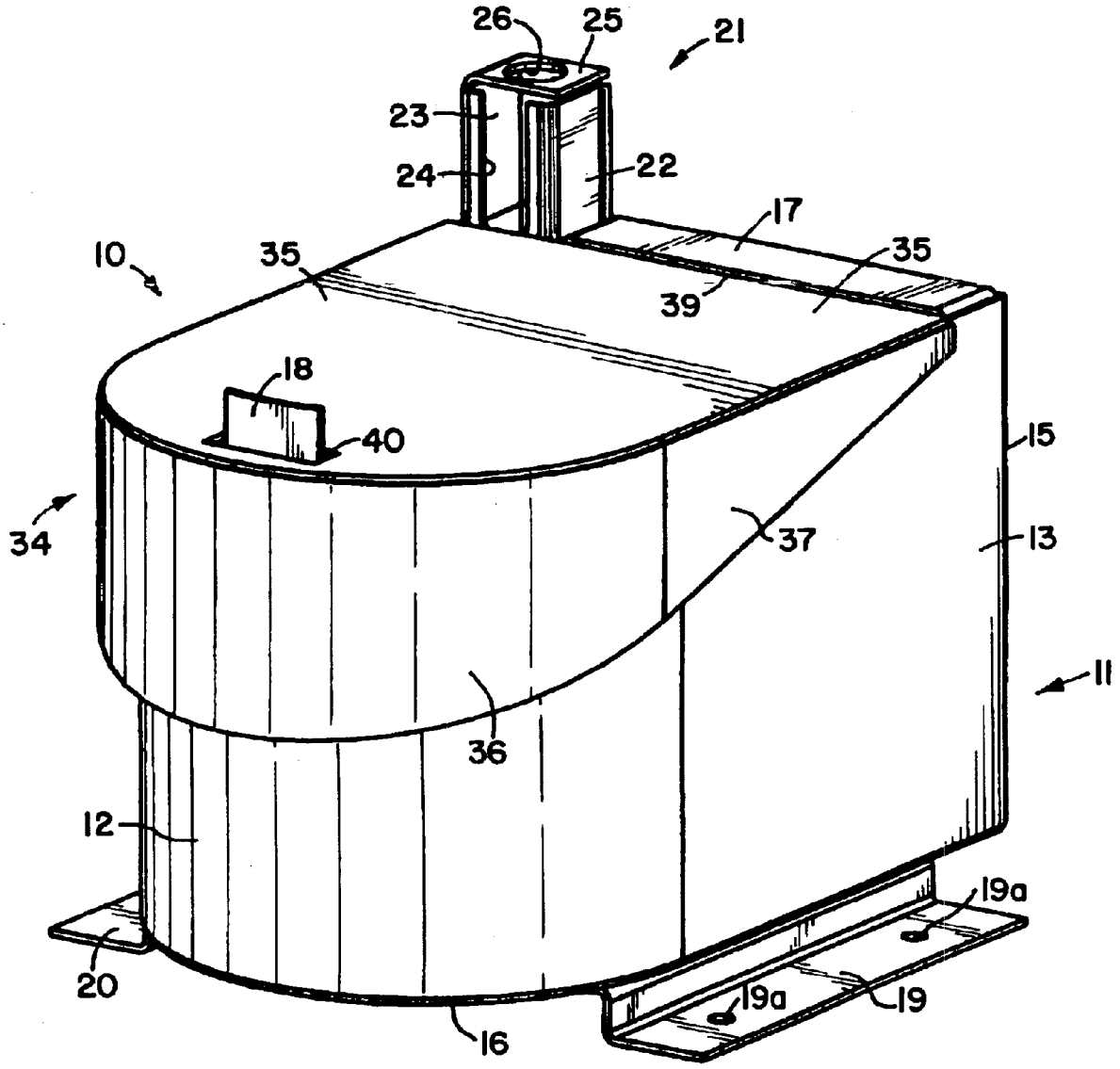
FIG. 1 is a side perspective view of a preferred embodiment dispenser constructed according to the principles of the present invention.
Figure 2:
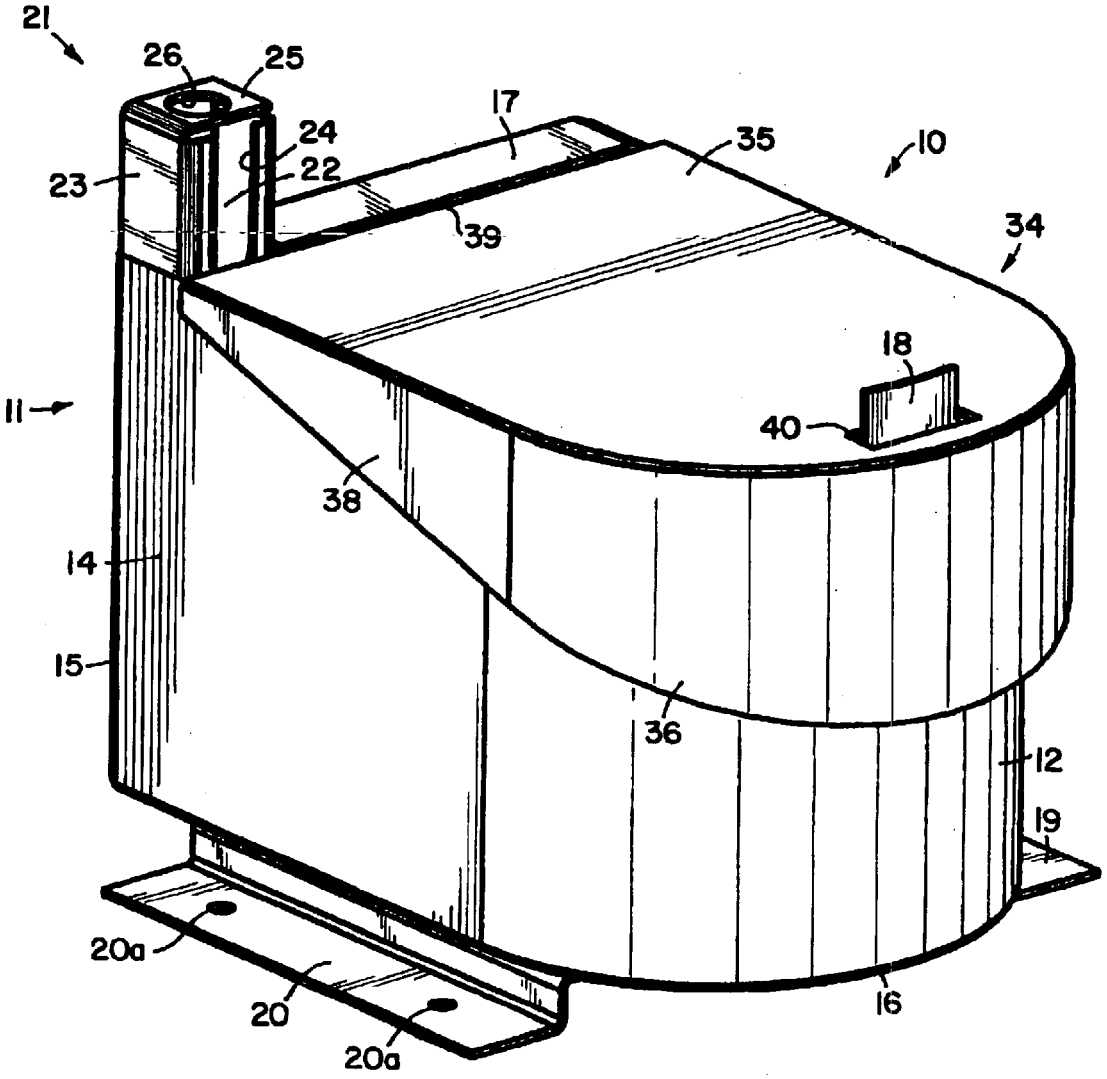
FIG. 2 is another side perspective view of the dispenser shown in FIG. 1.
Figure 3:
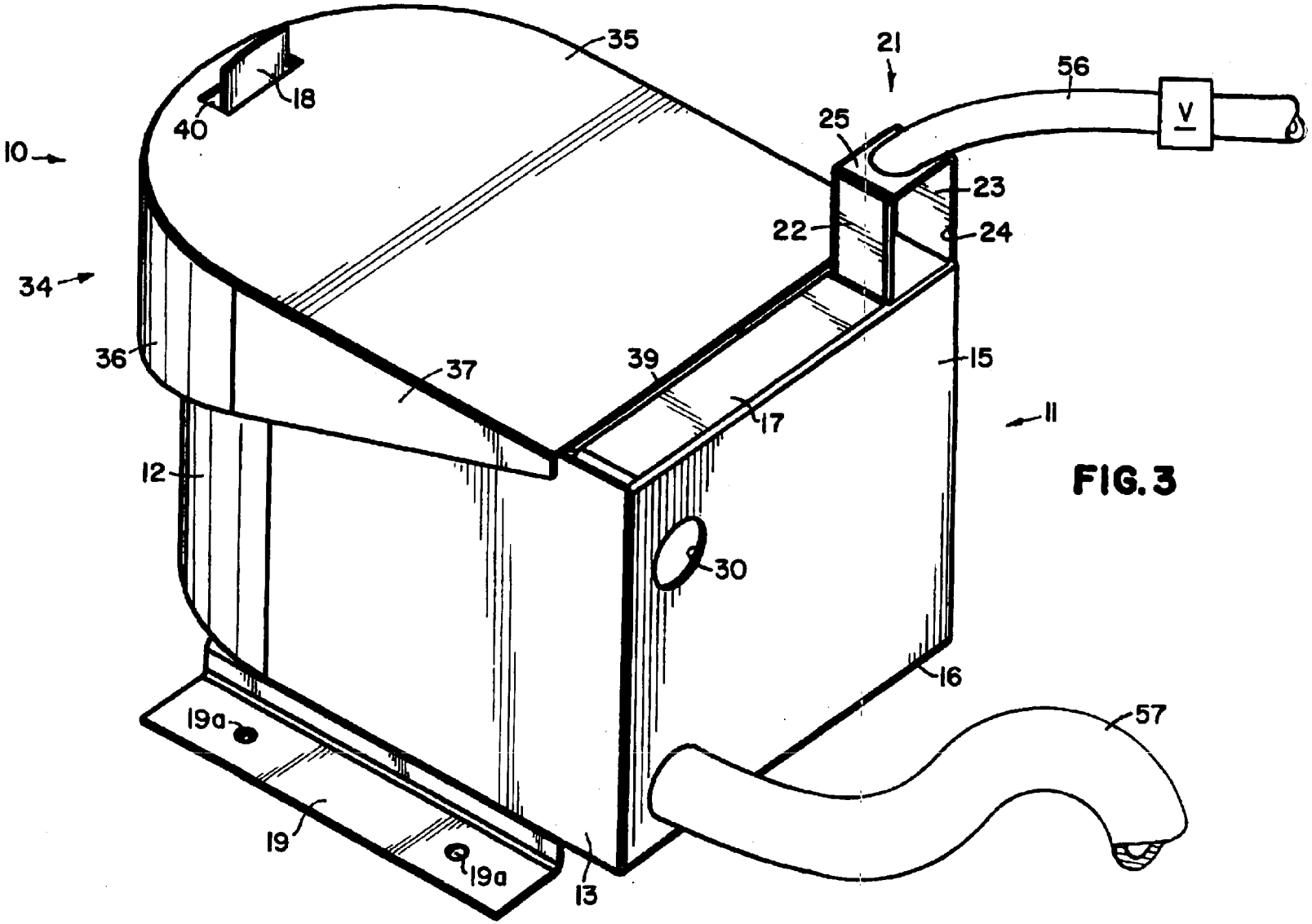
FIG. 3 is a rear perspective view of the dispenser shown in FIG. 1.
Figure 4:
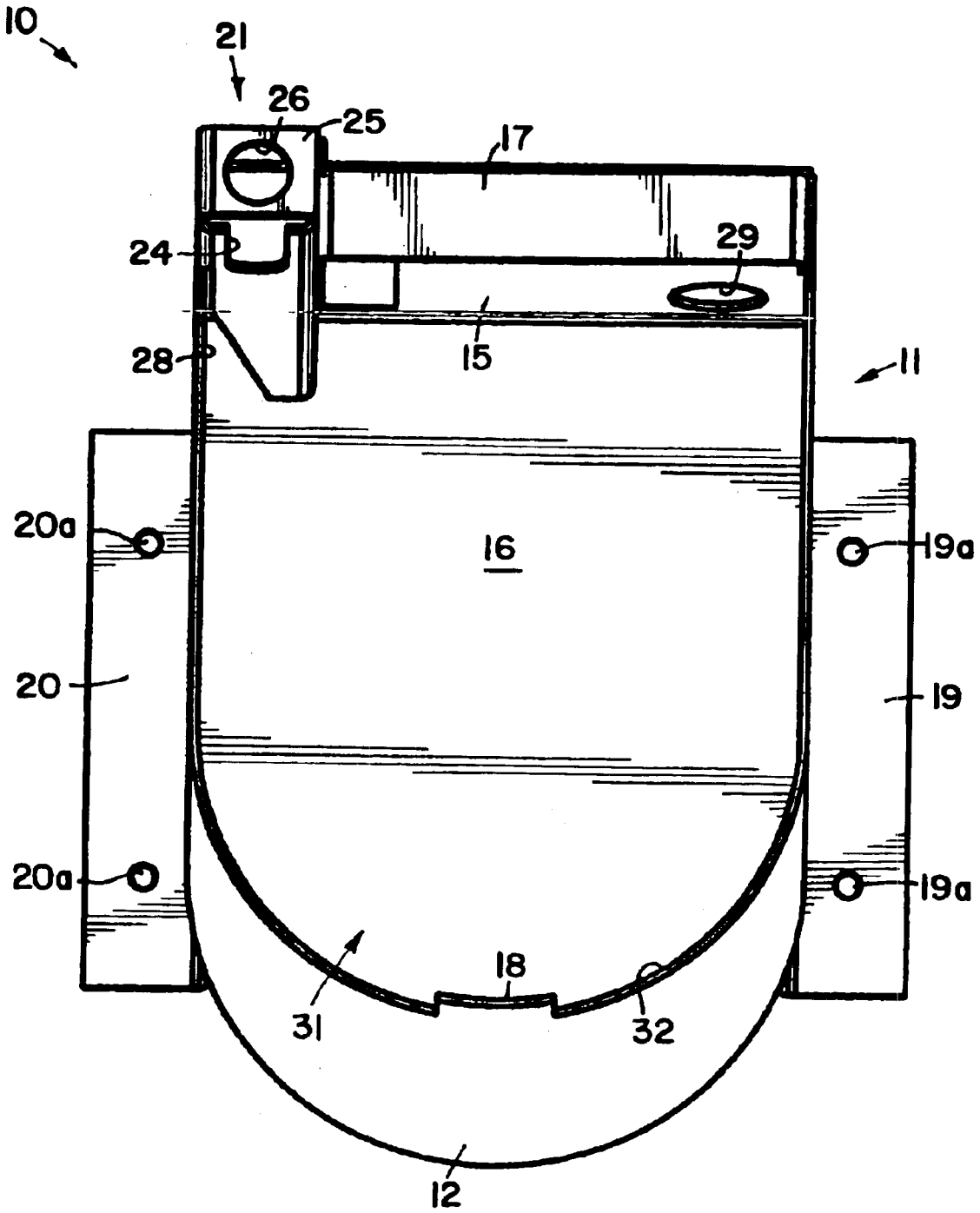
FIG. 4 is a top perspective view of the dispenser shown in FIG. 1 with the lid removed.
Figure 5:
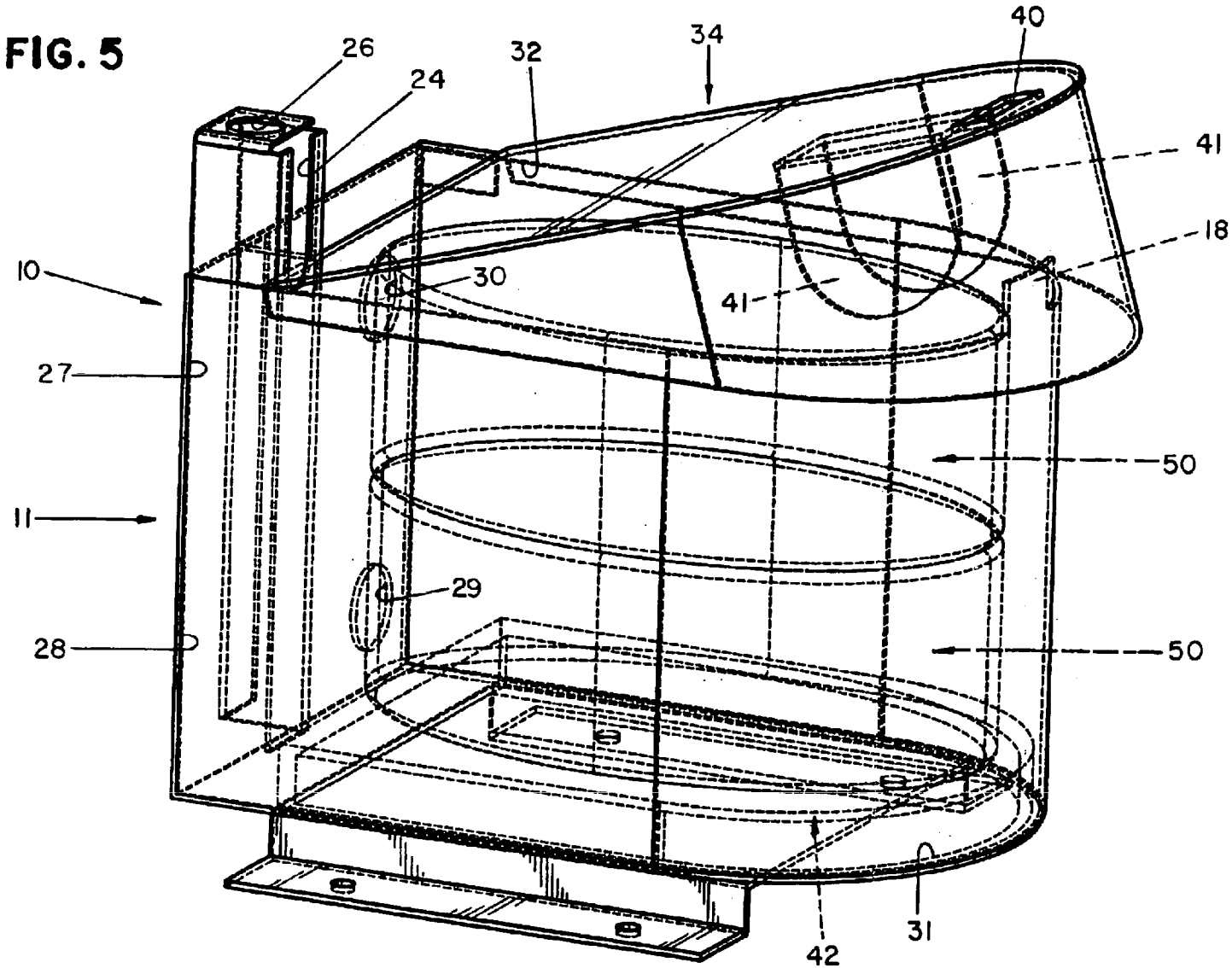
FIG. 5 is another side perspective view of the dispenser shown in FIG. 1.
Figure 6:
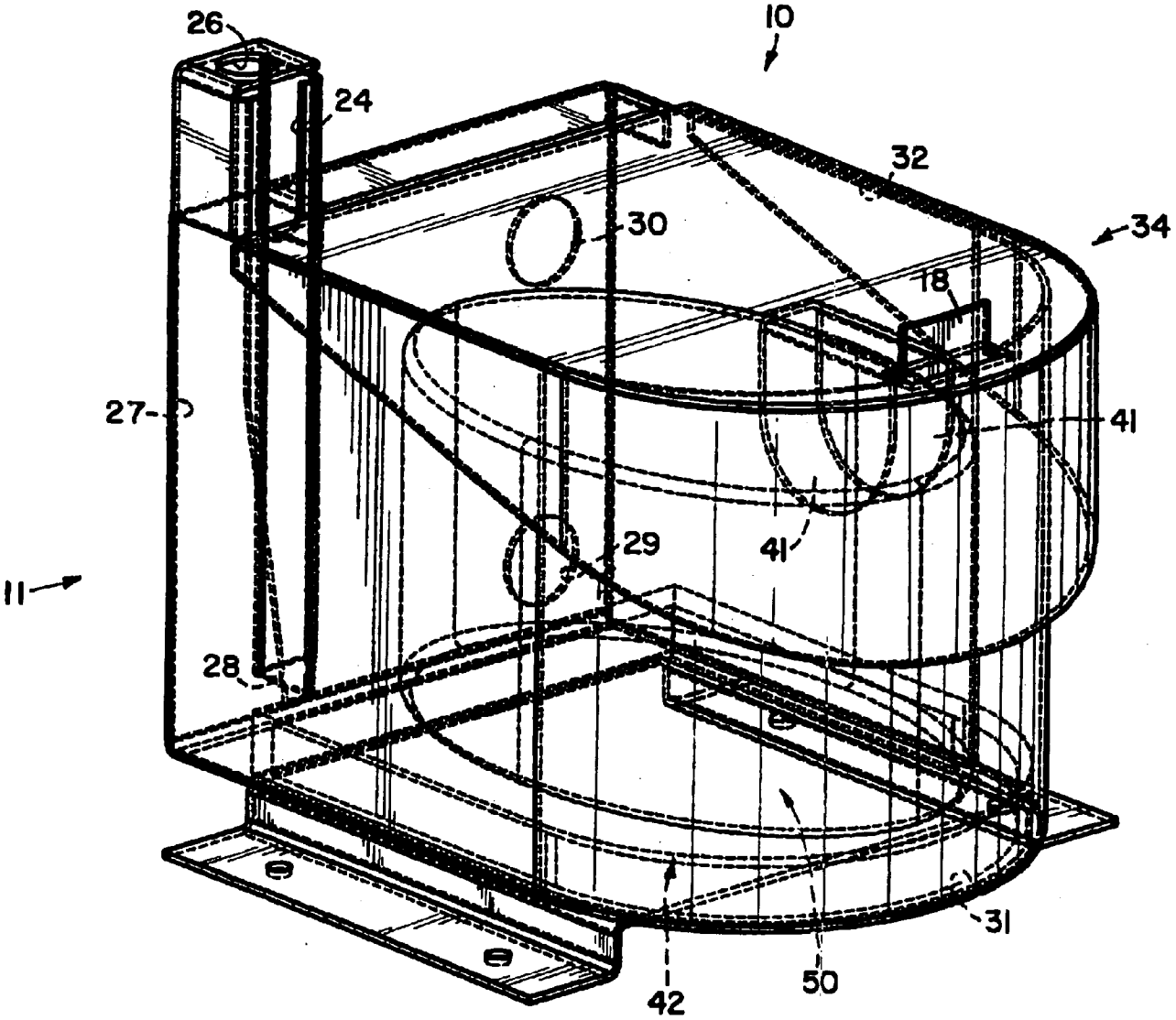
FIG. 6 is another side perspective view of the dispenser shown in FIG. 1.

FIG. 16 show a preferred embodiment dispenser 10 in various views. FIG. 5 and FIG. 6 show numerous hidden lines adjacent the edges and these hidden lines are to show the curvature of the edges, but it is understood that the edges could be square edges. Dispenser 10 includes chamber 11 and lid 34. Chamber 11 includes a rounded front portion 12 connected on one side to first side portion 13 and connected on the opposite side to second side portion 14. First side portion 13 and second side portion 14 are also connected to back portion 15 on the sides opposite those connected to front portion 12. Bottom portion 16 is connected to the bottom edges of portions 12–15, thus enclosing the bottom of chamber 11. Top portion 17 is a narrow, rectangular shaped portion of chamber 11 connected to the top edge of back portion 15 and interconnecting the top edge of first side portion 13 proximate back portion 15 and first side 22 of water inlet 21. Top portion 17 does not extend along the full length of back portion 15 and only covers a relatively small segment of the top surface of chamber 11. Therefore, top portion 17 does not enclose the top of chamber 11, thus leaving opening 32 into chamber 11.

Chamber 11 defines cavity 31, which is accessible through opening 32 and is configured and arranged to receive solid detergent 50 or 60 and water from water inlet 21. Within cavity 31, solid detergent 50 or 60 rests on top of support member 42, shown in FIG. 5 and FIG. 6, which is proximate bottom portion 16 and extends across cavity 31. Support member 42 is a screen type structure that holds solid detergent 50 or 60 and allows water to pass through. Back portion 15 of chamber 11 includes water inlet 21 proximate top portion 17 and second side portion 14 and water outlet 29 proximate bottom portion 16 and first side portion 13. Back portion 15 also includes overflow outlet 30, which allows excess water inside cavity 31 of chamber 11 to readily escape in the event too much water flows into cavity 31.

Water inlet 21 includes first side 22, second side 23, top 25, and tunnel 27. First side 22 is proximate back portion 15 and second side portion 14, and second side 23 is proximate back portion 15 and top portion 17. First side 22 and second side 23 are parallel to one another and extend approximately 1½ inches above top portion 17. The top edges of first side 22 and second side 23 are interconnected by top 25, which includes opening 26 where water flows from a water source into water inlet 21. Opening 26 has a diameter of approximately ¼ to ½ inch. The space between first side 22 and second side 23 forms air gap 24. A one inch gap in air gap 24 is sufficient to ensure that excess water flowing into water inlet 21 does not return to the water source, thereby contaminating the water source. Providing air gap 24 is mandated by the ASSE plumbing code for back flow prevention.

Water inlet 21 is configured and arranged to receive water from a water source via conduit 56. Conduit 56 is operatively connected to water inlet 21 and to the water source, and valve V regulates the amount of water flowing from the water source into water inlet 21. Tunnel 27 is approximately 6½ inches long with wall dimensions of approximately one inch by one inch and extends from top portion 17 to approximately 1½ inches above bottom portion 16, and opening 28 of tunnel 27 allows water to flow into cavity 31. Therefore, the water flows into opening 26, through tunnel 27, and out of opening 28 into cavity 31 proximate bottom portion 16 of chamber 11. In the preferred embodiment, chamber 11 is filled with water from the bottom and the water level increases as water flows into the bottom of cavity 31 from opening 28. Opening 28 is located proximate bottom portion 16 at approximately the same height as support member 42. Therefore, the water fills cavity 31 beneath solid detergent 50 or 60 first and then rises above support member 42 to contact solid detergent 50 or 60 from the bottom of the detergent. Filling cavity 31 with water from the bottom of cavity 31 minimizes the vortices and the eddies, which tend to erode detergents unevenly. Less turbulence in the water occurs when cavity 31 is filled with water from the bottom, and this allows for less detergent to be dispensed than is typically dispensed in spray-type dispensers. In addition, this results in uniform dissolution of the detergent and a relatively constant concentration and shape of the detergent is maintained. Although it is recognized that cavity 31 may be flooded from the top, more turbulence in the water will occur and the detergents will likely erode unevenly resulting in a variance in concentration and shape of the detergent.

As cavity 31 is flooded with water from the bottom of chamber 11 to a level proximate the middle of chamber 11, the water contacts the solid detergent 50 or 60 and dissolves a portion of the solid detergent 50 or 60, creating a use solution. In the preferred embodiment, chamber 11 is flooded with water approximately 3 to 4 inches above support member 42. Only a relatively small portion of solid detergent 50 or 60 is dissolved each time water fills cavity 31 and contacts solid detergent 50 or 60. In the preferred embodiment, the amount of water flowing into cavity 31 may be adjusted by valve V controlling the amount of water flowing into water inlet 21, and the water level within cavity 31 is important to ensure the correct concentration of detergent used in the dishwashing machine. Since different models of dishwashing machines may have different sump sizes, the use solution may require different concentrations of detergent, and the concentration of detergent is controlled by allowing either more or less water into cavity 31 of dispenser 10. In a preferred embodiment dispenser 10, a solenoid valve or a meter valve is used to pump water into water inlet 21, but it is understood that any valve known in the art for pumping water into water inlet 21 may be used. A valve may not even be necessary if the dependent dishwashing machine has a solenoid valve controlling the input of the rinse water (e.g. Hobart AM Series). Also, particular detergents must be used with dispenser 10 to ensure the correct concentration of detergent is dissolved in the water. This is discussed in greater detail below.

Water outlet 29 is configured and arranged to allow substantially all of the water and the use solution to flow out of cavity 31 and into the dishwashing machine. Water outlet is approximately ¼ inch above bottom portion 16 of chamber 11. When substantially all of the water and the use solution flow out of cavity 31, substantially all means that enough of the water and the use solution are dispensed so that the water and the use solution are not in contact with solid detergent 50 or 60. The diameter of water outlet 29 is approximately ½ inch, and a hose is connected to water outlet 29 to allow the water and dissolved detergent to flow into the dishwashing machine. Although it is unlikely that solid pellet detergent 60 would flow out of cavity 31 along with the use solution, it is possible, especially if overflow outlet 30 is used. Therefore, a screen or other sieve type member known in the art may be used to prevent solid pellet detergent 60 from flowing out of water outlet 29 or overflow outlet 30 along with the water and dissolved detergent.

In a preferred embodiment, water outlet 29 is always open and substantially all of the water in cavity 31 is dispensed through water outlet 29 so that no water is in contact with solid detergent 50 or 60 when no water is flowing into water inlet 21 and dispenser 10 is not in use. Therefore, in order for dispenser 10 to work properly, the rate of flow of water into cavity 31 must be greater than the rate of flow of water out of water outlet 29. The rate of water flowing into water inlet 21 depends upon several factors including the diameter and length of conduit 56 connected to water inlet 21 and the amount of pressure in the water supply. The maximum outflow of water from water outlet 29 is approximately 1.8 gallons per minute.

In another preferred embodiment, a hose member 57 is operatively connected to water outlet 29 to dispense the water and the use solution into the dishwashing machine. Hose member 57 extends downward below water outlet 29 to connect to the dishwashing machine. As hose member 57 approaches water outlet 29, hose member 57 extends upward at a height greater than the height of water outlet 29 with respect to its location on back portion 15 and then extends downward to operatively connect to water outlet 29. This curvature of hose member 57 prevents water at a level below the curvature from readily flowing out of water outlet 29 because the water is not initially able to flow up and beyond the point of curvature of hose member 57. However, once water begins flowing into cavity 31 at a level above the curvature, water will begin flowing out of cavity 31 via hose member 57 connected to water outlet 29. Adding water to a level above the curvature initiates the flow of substantially all of the use solution out of water outlet 29, and water will flow out of water outlet 29 because a siphoning effect occurs. The siphoning effect occurs because once water reaches a level above the curvature of hose member 57, water outlet 29 fills up with water completely before the water drains out of water outlet 29 very quickly. Once the water begins flowing out of water outlet 29, it will continue to flow until the water level within cavity 31 is below water outlet 29. This is because the siphoning effect creates a vacuum within hose member 57 and water drains out of water outlet 29 even though water is no longer being supplied to water inlet 21. As a result, the only valve necessary for dispenser 10 is valve V to control the water flowing from the water source into water inlet 21, and an additional valve is not required to control the amount of water flowing out of water outlet 29. The rate of water flowing out of water outlet 29 depends upon the diameter of hose member 57, but the maximum outflow of water from water outlet 29 is approximately 1.8 gallons per minute.

The preferred embodiment including hose member 57 is best suited for use with solid block detergent 50 because a longer exposure time with water is necessary to obtain the desired concentration of detergent in the use solution. This is because there is less effective surface area in contact with the water and, therefore, detergent 50 has a lower solubility rate than detergent 60. The preferred embodiment allows cavity 31 to be filled with a level of water below the curvature of hose member 57 for a period of time, allowing the water to contact detergent 50 for the period of time without draining out of cavity 31. Therefore, the detergent soaks in the water to create a use solution, and then the water and use solution drain out of water outlet 29 when more water is added to cavity 31. The addition of more water within cavity 31 above the curvature of hose member 57 initiates the siphoning effect of water outlet 29, thus dispensing the use solution into the dishwashing machine.

Lid 34 includes a rounded front 36, which is connected on one side to first side 37 and is connected on its opposite side to second side 38. The center portion of front 36 is wider than the side portions of front 36, and therefore front 36 tapers slightly as it approaches sides 37 and 38. In addition, sides 37 and 38 are wider where they connect to front 36 and taper as they approach back portion 15. The tapering of front 36 and sides 37 and 38 from front to back ensures that opening 32 of cavity 31 remains covered by lid 34 even though lid 34 may not be closed completely on chamber 11. Therefore, as shown in FIG. 5, lid 34 still covers opening 32 of cavity 31 when top 35 is at an angle of approximately 0° to 30° with respect to bottom portion 16. Front 36, first side 37, and second side 38 of lid 34 conform to front portion 12, first side portion 13, and second side portion 14 of chamber 11, respectively. Top 35 of lid 34 is connected to the top edges of front 36, first side 37, and second side 38 and effectively covers opening 32 of cavity 31 when lid 34 is attached to chamber 11. Back 39 of top 35 is connected to top portion 17 of chamber 11 via a hinge member. It is understood that detergent dispenser 10 may be its own, separate unit or it may be combined within a unit including electronic controls for the dishwashing machine and a rack.

An additional feature of chamber 11 is low level indicator tab 18. Low level indicator tab 18 is an extension of the center top edge of front portion 12 and protrudes through opening 40 of top 35 when the level of solid detergent 50 or 60 is low. A label displaying the word "low" or some other word or phrase on it may be placed on tab 18 as a reminder that the level of solid detergent 50 or 60 is low and should be refilled. Curved structures 41, shown in FIG. 5 and FIG. 6, are proximate opening 40 on the inside surface of top 35 of lid 34. Curved structures 41 are configured and arranged to contact solid detergent 50 or 60 and as the level of solid detergent 50 or 60 decreases, lid 34 lowers. As lid 34 gradually lowers onto chamber 11, tab 18 gradually begins to protrude through opening 40 and indicates when solid detergent 50 or 60 should be refilled.

Other additional features of chamber 11 include first connecting member 19 and second connecting member 20. First connecting member 19 includes apertures 19*a* and second connecting member 20 includes apertures 20*a*. Screws or some other type of fastening means are positioned through apertures 19*a* and 20*a* to secure connecting members 19 and 20 to a dishwashing machine, thus securing dispenser 10 to a dishwashing machine.

As stated previously, only particular detergents may be used with dispenser 10 to ensure the right rate of dissolution of the detergent is achieved, thus ensuring the right concentration of detergent is used in the dishwashing machine. Typically, powder detergents are unsuitable detergents to be used with dispenser 10 because they tend to dissolve too quickly and clog dispenser 10. A problem that may occur with solid caustic detergents is that sloughing may occur when the detergents become too saturated with water. When a detergent absorbs too much water, it becomes pasty and falls apart in clumps that are not effective for use with a dispenser because the desired concentration cannot be obtained. Solid detergents 50 and 60 have a composition that prevents this from happening.

In the preferred embodiment, only a relatively small portion of solid detergent 50 or 60 is dissolved each time water floods cavity 31. Therefore, a uniform erosion pattern of the detergent occurs when it is dissolved in water to ensure the right concentration of detergent is used in the dishwashing machine. Uniform erosion is important because there is a linear relationship between the surface area of the detergent exposed to the water and the number of grams of detergent dispensed. Therefore, if the shape of the detergent remains relatively constant, the surface area of the detergent will remain relatively constant and the exposure to water will keep dispensing rate relatively constant.

Generally, there are three variables that determine the rate of dissolution of the detergent, but these variables are not exhaustive. These variables are the amount of water used within cavity 31 to dissolve the detergent, the length of time the detergent is exposed to the water, and the temperature of the water. The more water that flows into cavity 31 to contact the detergent and the longer the detergent is exposed to the water, the more detergent will dissolve into the water. Although the temperature of the water used to flood cavity 31 does not make a huge difference in the rate of dissolution of the particular detergents used in dispenser 10, it affects the rate of dissolution more as the length of time the detergents are exposed to the water increases. See Tables 1, 2, and 3 below.

TABLE 1

Solubility Ranges for Solid Block Detergent (500 g) in 1000 ml of Water

| Water Temperature (Fahrenheit) | Time (seconds) | Weight Dissolved (grams) |
|---|---|---|
| 120 | 30 | 0.60 |
| 120 | 60 | 1.62 |
| 140 | 30 | 4.60 |
| 140 | 60 | 10.20 |
| 160 | 30 | 7.42 |
| 160 | 60 | 18.30 |

TABLE 2

Solubility Ranges for Solid Pellet Detergent (500 g) in 1000 ml of Water

| Temperature (Fahrenheit) | Time (seconds) | Weight Dissolved (grams) |
|---|---|---|
| 120 | 30 | 2.10 |
| 120 | 60 | 5.75 |
| 140 | 30 | 16.32 |
| 140 | 60 | 36.55 |
| 160 | 30 | 35.87 |
| 160 | 60 | 52.40 |

TABLE 3

Solubility Ranges for Solid Caustic Detergent (500 grams) in 1000 ml of Water

| Temperature (Fahrenheit) | Time (seconds) | Weight Dissolved (grams) |
|---|---|---|
| 120 | 30 | 30.20 |
| 120 | 60 | 101.80 |
| 140 | 30 | 60.80 |
| 140 | 60 | 220.40 |

Table 1 represents detergents having the same composition as solid block detergent 50, and Table 2 represents detergents having the same composition as solid pellet detergent 60. Table 3 represents typical powder detergents having compositions that will dissolve too quickly and, therefore, they will be unsuitable detergents for use with dispenser 10.

TABLE 4

Solubility of Solid Carbonate Based Detergent with Varying Effective Surface Areas

| Effective Surface Area ($in^2$) | Product Dispensed (grams) |
|---|---|
| 25.12 | 43.20 |
| 35.33 | 48.00 |
| 60.44 | 62.40 |
| 125.60 | 168.00 |

Table 4 shows how the effective surface area, the area in which water has the opportunity to come in contact with the surface of the detergent, affects the amount of detergent dispensed. Dispenser 10 was loaded with various shapes of the solid carbonate based detergent. The 25.12 $in^2$ effective surface area represents a cylindrical shaped detergent with a four inch diameter, the 35.33 $in^2$ effective surface area represents a cylindrical shaped detergent with a five inch diameter, and the 60.44 $in^2$ effective surface area represents a cylindrical shaped detergent with a seven inch diameter. The 125.60 $in^2$ effective surface area represents a pellet shaped detergent. Then, six gallons of water was passed through dispenser 10 at a rate of two gallons per minute. The effluent from dispenser 10 was collected and the water was evaporated, and the resulting solid was weighed. From this test, the results of which are shown in Table 4, it was determined that the smaller the effective surface area, the less number of grams available for dispensing into the wash tank. Therefore, to get the desired concentration of use solution from the various shapes of detergent, the three variables discussed above may be adjusted to accommodate the different effective surface areas. For example, the length of time the detergent is exposed to water should be shortened for pellets due to the greater effective surface area, and therefore, dispenser 10 should be used without hose member 57 to eliminate the siphoning effect.

FIG. 7 shows a solid block detergent 50. Solid block detergent 50 has a unique elliptical profile. The characteristics ensure that solid block detergent 50 may be placed inside only particular dispensers having a correspondingly shaped location for receiving detergent. The shape of solid block detergent 50 and the correspondingly shaped location for receiving the detergent within a particular dispenser also ensures that an unsuitable substitute may not easily be placed inside the dispenser for use in a dishwashing machine. In FIG. 7, the solid block detergent 50 is shown having a cast solid block 51, which is revealed by removal of part of the packaging 52. Solid block detergent 50 has a mass of at least 500 grams, preferably 1 to 10 kilograms. Packaging 52 includes score lines 55. Score lines 55 provide easy removal of packaging 52 from cast solid block 51. Examples of how the composition of solid block detergent 50 is processed are disclosed in U.S. patent application Ser. Nos. 08/781,493 and 08/782,457 by Lentsch et al. filed on Jan. 13, 1997, the disclosures of which are incorporated by reference herein.

Typically two thin solid blocks 51 are stacked upon one another inside cavity 31 to retain a relatively constant supply of detergent within dispenser 10. A constant supply of detergent is important to maintain a relatively constant rate of dissolution of the detergent and therefore to maintain a relatively constant concentration of detergent for use in a dishwashing machine. Solid block detergent 50 has a dimension of approximately 2.13 by 4.00 by 6.36 inches. The solubility ranges for solid block detergent 50 are shown above in Table 1, and the preferred concentration of the use solution created from solid block detergent 50 flowing out of dispenser 10 is approximately 0.25% to 0.50% weight to weight.

In the preferred embodiment, the preferred shape of the solid detergent for use in dispenser 10 is a pellet. FIG. 8 shows a perspective view of solid pellet detergent 60. Solid pellet detergent 60 has a dimension of approximately 0.75 by 2.00 inches. Approximately 50 pellets are used with dispenser 10. The solubility ranges for solid pellet detergent 60 are shown above in Table 2, and the preferred concentration of the use solution created from solid pellet detergent 60 flowing out of dispenser 10 is approximately 0.75% to 1.25% weight to weight. The preferred concentration of the use solution created from solid pellet detergent 60 is higher than the use solution created from solid block detergent 50, and this is due to the increased surface area of solid pellet detergent 60 exposed to the water flowing into cavity 31.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method for dispensing a use solution from a solid detergent into a washing machine, comprising the steps of:

a. placing a solid detergent having a bottom in a dispenser, the dispenser having a chamber, the chamber defining a cavity and including a water inlet and a water outlet, and the cavity being configured and arranged to receive the solid detergent;

b. supplying water to the water inlet of the dispenser, wherein the water is supplied to a level within the cavity of the chamber thereby having contact with the solid detergent;

c. flooding the cavity with water from the bottom of the solid detergent;

d. dissolving a relatively small portion of the solid detergent in the water and forming a use solution, the solid detergent being dispensed completely over more than one flooding of water within the cavity; and e. releasing the use solution from the dispense via the water outlet, wherein the use solution flows out of the chamber through the water outlet and into the washing machine.

2. The method for dispensing a use solution from a solid detergent into a washing machine of claim 1, wherein the level of water within the cavity of the chamber is approximately ¼ inch to 3 inches.

3. The method for dispensing a use solution from a solid detergent into a washing machine of claim 1, wherein the water has a temperature of approximately 80 to 180° F.

4. The method for dispensing a use solution from a solid detergent into a washing machine of claim 1, wherein the water outlet is always open and the water flows into the water inlet at approximately 0.1 gallon to 2 gallons per minute and the water flows out of the water outlet at approximately 0.1 to 1 gallon per minute.

5. The method for dispensing a use solution from a solid detergent into a washing machine of claim 1, wherein the use solution from the solid detergent is dispensed into the washing machine having a concentration of 0.1% to 1.5% weight to weight.

6. The method for dispensing a use solution from a solid detergent into a washing machine of claim 1, wherein uniform dissolution of the solid detergent occurs, thereby maintaining a relatively constant concentration and a relatively constant shape of the solid detergent.

7. The method for dispensing a use solution from a solid detergent into a washing machine of claim 1, further comprising flooding said cavity with water to a first level, wherein said first level of water contacts said solid detergent contained within said cavity to form a use solution, said solid detergent being dispensed completely over more than one flooding of water within said cavity, and flooding said cavity with water to a second level, wherein said second level of water initiates the flow of substantially all of said use solution out of said water outlet into a washing machine.

8. A detergent dispenser, comprising:

a. solid detergent having a bottom;

b. a water source providing water to the detergent dispenser and c. a chamber defining a cavity configured and arranged to receive the solid detergent and the water, said chamber including a water inlet and a water outlet, the water inlet being configured and arranged to receive the water from the water source, wherein the water flows into the cavity, floods the solid detergent from the bottom of the solid detergent and dissolves a portion of the solid detergent to form a use solution, the solid detergent being dispensed completely over more than one flooding of water within the cavity, and wherein the water outlet is configured and arranged to dispense substantially all of the use solution out of the chamber when the detergent dispenser is not in use.

9. The detergent dispenser of claim 8, further comprising a level of water within the cavity of the chamber, wherein the level of water is approximately ¼ inch to 3 inches.

10. The detergent dispenser of claim 8, wherein the water has a temperature of approximately 80 to 180° F.

11. The detergent dispenser of claim 8, wherein the we outlet is always open and the water flows into the water inlet at approximately 0.1 gallon to 2 gallons per minute and the water flows out of the water outlet at approximately 0.1 to 1 gallon per minute.

12. The detergent dispenser of claim 8, wherein the use solution from the solid detergent is dispensed into the washing machine having a concentration of 0.1% to 1.5% weight to weight.

13. The detergent dispenser of claim 8, wherein uniform dissolution of the solid detergent occurs, thereby maintaining a relatively constant concentration and a relatively constant shape of the solid detergent.

14. The detergent dispenser of claim 8, further comprising:

a. a hose member operatively connected to said water outlet and having a curvature, wherein said curvature extends in an upward direction at a height greater than said water outlet and then extends downward below said water outlet;

b. a first level of water within said cavity at a height below said curvature, wherein said first level of water remains in said cavity and does not flow out of said water outlet; and c. a second level of water within sad cavity at a height greater than said curvature, wherein a siphoning effect occurs and substantially all of the water flows out of said cavity via said water outlet.

15. A dispenser for dispensing a use solution from a solid detergent into a washing machine, comprising:

a. a solid detergent;

b. a water source providing water to the dispenser;

c. a chamber including a front portion, a first side portion, a second side portion, a back portion, a bottom portion, a top portion, and an opening, the chamber defining a cavity configured and arranged to receive the solid detergent and the water, the back portion of the chamber further comprising a water inlet proximate the top portion and a water outlet proximate the bottom portion, the water inlet being configured and arranged to receive the water from the water source, whereby the water flows into the cavity from the bottom of the chamber where it contacts the solid detergent and dissolves a portion of the solid detergent to form a use solution, the solid detergent being dispensed completely over more than one flooding of water within the cavity, and whereby the water outlet is configured and arranged to dispense substantially all of the water and the use solution out of the chamber and into the washing machine when the dispenser is not in use;

d. an air gap proximate the water inlet to prevent the water from returning to the water source;

e. a tunnel proximate the back portion and the second side portion, wherein the water travels from the water inlet, through the tunnel, and into the bottom portion of the chamber;

f. a level of the water within the cavity of the chamber contacting the solid detergent, wherein uniform dissolution of the solid detergent occurs thereby maintaining a relatively constant concentration and a relatively constant shape of the solid detergent; and g. a lid connected to the top portion of the chamber, whereby the lid covers the opening of the chamber into the cavity.

16. The dispenser for dispensing a use solution from a solid detergent into a washing machine of claim 15, wherein the level of water within the cavity of the chamber is approximately ¼ inch to 3 inches.

17. The dispenser for dispensing a use solution from a solid detergent into a washing machine of claim 15, wherein the water has a temperature of approximately 80 to 180° F.

18. The dispenser for dispensing a use solution from a solid detergent into a washing machine of claim 13, wherein the water outlet is always open and the water flows into the water inlet at approximately 0.1 to 2 gallons per minute and the water flows out of the water outlet at approximately 0.1 to 1 gallon per minute.

19. The dispenser for dispensing a use solution from a solid detergent into a washing machine of claim 15, wherein the use solution from the solid detergent is dispensed into the washing machine having a concentration of 0.1% to 1.5% weight to weight.

20. The dispenser for dispensing a use solution from the solid detergent into a washing machine of claim 15, further comprising a tab extending from and operatively connected to said front portion of said chamber and an opening in said lid, wherein said tab extends through said opening when said solid detergent should be added to said dispenser.

21. The dispenser for dispensing a use solution from a solid detergent into a washing machine of claim 15, further comprising:

a. a hose member operatively connected to said water outlet and having a curvature, wherein said curvature extends in an upward direction at a height greater than said water outlet and then extends downward below said water outlet;

b. a first level of water within said cavity at a height below said curvature, wherein said first level of water remains in said cavity and does not flow out of said water outlet; and c. a second level of water within said cavity at a height greater than said curvature, wherein a siphoning effect occurs and substantially all of the water flows out of said cavity via said water outlet.

22. A method for dispensing detergent, comprising the steps of:

a. placing a detergent with a particular composition into a dispenser having a cavity, a water inlet, and a water outlet, said cavity being configured and arranged to receive and support said detergent;

b. supplying water to said water inlet and using a valve to control the amount of water flowing into said water inlet;

c. flooding said dispenser with water to a level within said cavity wherein said water contacts said detergent and dissolves a portion of said detergent to form a use solution, the detergent being dispensed completely over more than on flooding of water within the cavity; and d. releasing said use solution through said water outlet, thereby dispensing a particular concentration of said use solution, when in said water outlet is always open, and wherein water is supplied to said water inlet at a rate faster than water is released through said water outlet, thereby allowing the water to contact the detergent and dissolve a portion of said detergent to form said use solution.

23. The method for dispensing detergent of claim 22, further comprising flooding said cavity with water to a first level, wherein said first level of water contacts said detergent contained within said cavity to form a use solution, said detergent being dispensed completely over more than one flooding of water within said cavity, and flooding said cavity with water to a second level, wherein said second level of water initiates the flow of substantially all of said use solution out of said water outlet into a washing machine.

24. A dispenser for dispensing a use solution from a solid detergent into a washing machine, comprising:

a. a solid detergent having a bottom;

b. a dispenser including a cavity, a water inlet, and a water outlet, wherein said cavity is configured and arranged to receive and support said solid detergent;

c. a conduit connecting said water inlet to a water source;

d. a valve operatively connected to said conduit controlling the flow of water from said water source into said water inlet, wherein said cavity is flooded with water to a level within said cavity, wherein water contacts said solid detergent from the bottom of said solid detergent and a uniform dissolution of said solid detergent occurs thereby maintaining a relatively constant concentration and a relatively constant shape of the solid detergent, and wherein a use solution is formed, solid detergent being dispensed completely over more than one flooding of water within the cavity; and e. a hose member connecting said water outlet to a washing machine, wherein substantially all of said use solution is dispensed out of said cavity through said water outlet and into the washing machine via said hose member.

25. The dispenser for dispensing a use solution from a solid detergent into a washing machine of claim 24, further comprising:

a. a curvature of said hose member, said curvature extending in an upward direction at a height greater than said water outlet and then extending downward below said water outlet;

b. a first level of water within said cavity at a height below said curvature, said first level of water remaining in said cavity and not flowing out of said water outlet; and c. a second level of water within said cavity at a height than said curvature, wherein a siphoning effect occurs and substantially all of the water flows out of said cavity via said water outlet.

26. A detergent dispenser for use with a washing machine, comprising:

a. a dispenser having a chamber including a cavity, a water inlet and a water outlet;

b. a solid detergent;

c. a conduit connecting said water inlet to a water source;

d. a valve operatively connected to said conduit, wherein said valve controls the amount of water flowing from said water source into said water inlet;

e. a hose member operatively connected to said water outlet and having a curvature, wherein said curvature extends in an upward direction at a height greater than said water outlet and then extends downward below said water outlet;

f. a first level of water within said cavity controlled by said valve to reach a height below said curvature, wherein said first level of water remains in said cavity and does not flow out of said water outlet; and g. a second level of water within said cavity controlled by said valve to reach a height greater than said curvature, wherein a siphoning effect occurs and substantially all of the water flows out of said dispenser via said water outlet, said solid detergent being dispensed completely over more than one flooding of water within said cavity.

27. A method of dispensing a use solution from a solid detergent into a washing machine, comprising the steps of:

a. placing a solid detergent inside a dispenser having a cavity, a water inlet, a water outlet, and a hose member operatively connected to said water outlet, said hose member having a curvature, wherein said curvature extends in an upward direction at a height greater than said water outlet and then extends downward below said water outlet;

b. supplying water to said water inlet, wherein water flows from said water inlet into said cavity;

c. controlling the amount of water flowing into said water inlet with a valve;

d. flooding said cavity with water to a first level, wherein said first level of water contacts said solid detergent contained within said dispenser to form a use solution; and e. flooding said cavity with water to a second level, wherein said second level of water initiates the flow of substantially all of said use solution out of said water outlet into a washing machine, the solid detergent being dispensed completely over more than one flooding of water within the cavity.

* * * * *

UNITED STATES PATENT AND TRADEMARK OFFICE

CERTIFICATE OF CORRECTION

PATENT NO. : 6,773,668 B1
DATED : August 10, 2004
INVENTOR(S) : Terrence P. Everson et al.

It is certified that error appears in the above-identified patent and that said Letters Patent is hereby corrected as shown below:

Title page,
Item [75], Inventors, please delete "Edward" and insert therefore -- Eddie --
Item [73], Assignee, after "Ecolab" please delete ","

Column 5,
Line 6, delete "FIG. 16" and insert therefore -- FIGS. 1-6 --

Column 10,
Line 55, delete "p" and insert therefore -- P --
Line 55, delete "a" and insert therefore -- A --

Column 12,
Line 19, after "dispenser" add -- ; --
Line 38, delete "we" and insert therefore -- water --
Line 62, delete "sad" and insert therefore -- said --

Column 14,
Line 27, after "solution", delete "when in" and insert therefore -- wherein --

Column 15,
Line 9, before "than" please insert therefore -- greater --

Signed and Sealed this

Fifteenth Day of February, 2005

JON W. DUDAS
*Director of the United States Patent and Trademark Office*